US008280287B2

(12) United States Patent
Mashtare et al.

(10) Patent No.: US 8,280,287 B2
(45) Date of Patent: Oct. 2, 2012

(54) MULTI-STAGE FIXING SYSTEMS, PRINTING APPARATUSES AND METHODS OF FIXING MARKING MATERIAL TO SUBSTRATES

(75) Inventors: Dale R. Mashtare, Bloomfield, NY (US); Shu Chang, Pittsford, NY (US); Grace T. Brewington, Fairport, NY (US); John F. Knapp, Fairport, NY (US); Anthony S. Condello, Webster, NY (US); Daniel M. Bray, Rochester, NY (US); Paul J. McConville, Webster, NY (US); Jason M. LeFevre, Penfield, NY (US); Karen A. Moffat, Brantford (CA); Jordan H. Wosnick, Toronto (CA); Santokh S. Badesha, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 6 days.

(21) Appl. No.: 12/855,011

(22) Filed: Aug. 12, 2010

(65) Prior Publication Data

US 2012/0039642 A1 Feb. 16, 2012

(51) Int. Cl.
*G03G 15/04* (2006.01)

(52) U.S. Cl. ..... 399/320

(58) Field of Classification Search ..... 399/33, 399/67, 122, 320, 307, 322, 327, 400, 329
See application file for complete search history.

(56) References Cited

U.S. PATENT DOCUMENTS 5,311,269 A * 5/1994 Aslam et al. ..... 399/329
5,832,347 A * 11/1998 Kawai et al. ..... 430/123.54
5,983,048 A * 11/1999 Moser ..... 399/67
6,212,356 B1 * 4/2001 Ishikawa et al. ..... 399/329
6,215,975 B1 * 4/2001 Berkes et al. ..... 399/327
7,322,689 B2 1/2008 Kohne et al.
7,402,371 B2 7/2008 Sacripante et al.
7,407,278 B2 8/2008 Kohne et al.
7,460,823 B2 * 12/2008 Asakura et al. ..... 399/340
7,494,757 B2 2/2009 Sacripante et al.
7,547,499 B2 6/2009 Veregin et al.
7,682,014 B2 3/2010 Snyder et al.
2004/0228643 A1 * 11/2004 Behnke et al. ..... 399/33
2007/0134030 A1 * 6/2007 Lior et al. ..... 399/307
2009/0009573 A1 1/2009 Larson et al.

(Continued)

OTHER PUBLICATIONS

James Williams et al.; Temperature Leveling Roller and Pressure Nip Assembly; U.S. Appl. No. 12/617,255, filed Nov. 12, 2009.

*Primary Examiner* — Kiho Kim

(74) *Attorney, Agent, or Firm* — Ronald E. Prass, Jr.; Prass LLP

(57) ABSTRACT

Multi-stage fixing systems for fixing toner to a substrate, printing apparatuses and methods of fixing marking material to a substrate are provided. An exemplary embodiment of the multi-stage fixing systems includes a softening device for softening toner applied to a substrate by a marking device; and a fixing device for fixing the softened toner to the substrate. The fixing device includes a first fixing member including a first surface; a first thermal energy source for actively heating the first surface; and a second fixing member including a second surface, the first surface and the second surface form a fixing nip at which the substrate with softened toner is received. The first fixing member and the second fixing member are operable to apply heat and pressure to the substrate and softened toner received at the fixing nip to fix the toner to the substrate.

39 Claims, 4 Drawing Sheets

U.S. PATENT DOCUMENTS

2009/0021550 A1 1/2009 Leighton et al.
2009/0087202 A1* 4/2009 Hurst et al. ..... 399/45
2009/0102906 A1 4/2009 Phillips et al.
2009/0297242 A1* 12/2009 Kanematsu ..... 399/400
2010/0045720 A1 2/2010 Williams et al.
2010/0322680 A1* 12/2010 Stelter ..... 399/320
2011/0008081 A1* 1/2011 Aoyama et al. ..... 399/327
2011/0064468 A1* 3/2011 Kawahata et al. ..... 399/122

* cited by examiner

MULTI-STAGE FIXING SYSTEMS, PRINTING APPARATUSES AND METHODS OF FIXING MARKING MATERIAL TO SUBSTRATES

RELATED APPLICATIONS

This application is related to the applications entitled "FIXING DEVICES FOR FIXING MARKING MATERIAL TO A WEB WITH CONTACT PRE-HEATING OF WEB AND MARKING MATERIAL AND METHODS OF FIXING MARKING MATERIAL TO A WEB" Ser. No. 12/855,036; "FIXING DEVICES INCLUDING LOW-VISCOSITY RELEASE AGENT APPLICATOR SYSTEM AND METHODS OF FIXING MARKING MATERIAL TO SUBSTRATES" Ser. No. 12/855,054; "FIXING DEVICES INCLUDING CONTACT PRE-HEATER AND METHODS OF FIXING MARKING MATERIAL TO SUBSTRATES" Ser. No. 12/855,066; "FIXING SYSTEMS INCLUDING IMAGE CONDITIONER AND IMAGE PRE-HEATER AND METHODS OF FIXING MARKING MATERIAL TO SUBSTRATES" Ser. No. 12/855,078; "FIXING DEVICES INCLUDING EXTENDED-LIFE COMPONENTS, PRINTING APPARATUSES AND METHODS OF FIXING MARKING MATERIAL TO SUBSTRATES" Ser. No. 12/855,106; and "LOW ADHESION COATINGS FOR IMAGE FIXING" Ser. No. 12/855,140, each of which is filed on the same date as the present application, commonly assigned to the assignee of the present application, and incorporated herein by reference in its entirety.

BACKGROUND

In some printing apparatuses, toner is applied to substrates to form toner images. The toner images can be heated while being subjected to pressure to fix the toner to the substrates. In such apparatuses, harsh conditions that occur in the fixing device can cause components of the fixing devices to fail prematurely.

It would be desirable to provide robust printing apparatuses and methods of fixing marking material to a substrate in printing that can provide images with high quality with low operating cost.

SUMMARY

Multi-stage fixing systems for fixing marking material to a substrate, printing apparatuses, and methods of fixing marking material to a substrate in printing are provided. An exemplary embodiment of the multi-stage fixing systems comprises a softening device for softening toner applied to a substrate by a marking device; and a fixing device for fixing the softened toner to the substrate. The fixing device comprises a first fixing member including a first surface; a first thermal energy source for actively heating the first surface; and a second fixing member including a second surface, the first surface and the second surface form a fixing nip at which the substrate with softened toner is received. The first fixing member and the second fixing member are operable to apply heat and pressure to the substrate and softened toner received at the fixing nip to fix the toner to the substrate.

DRAWINGS

DETAILED DESCRIPTION

Figure 1:
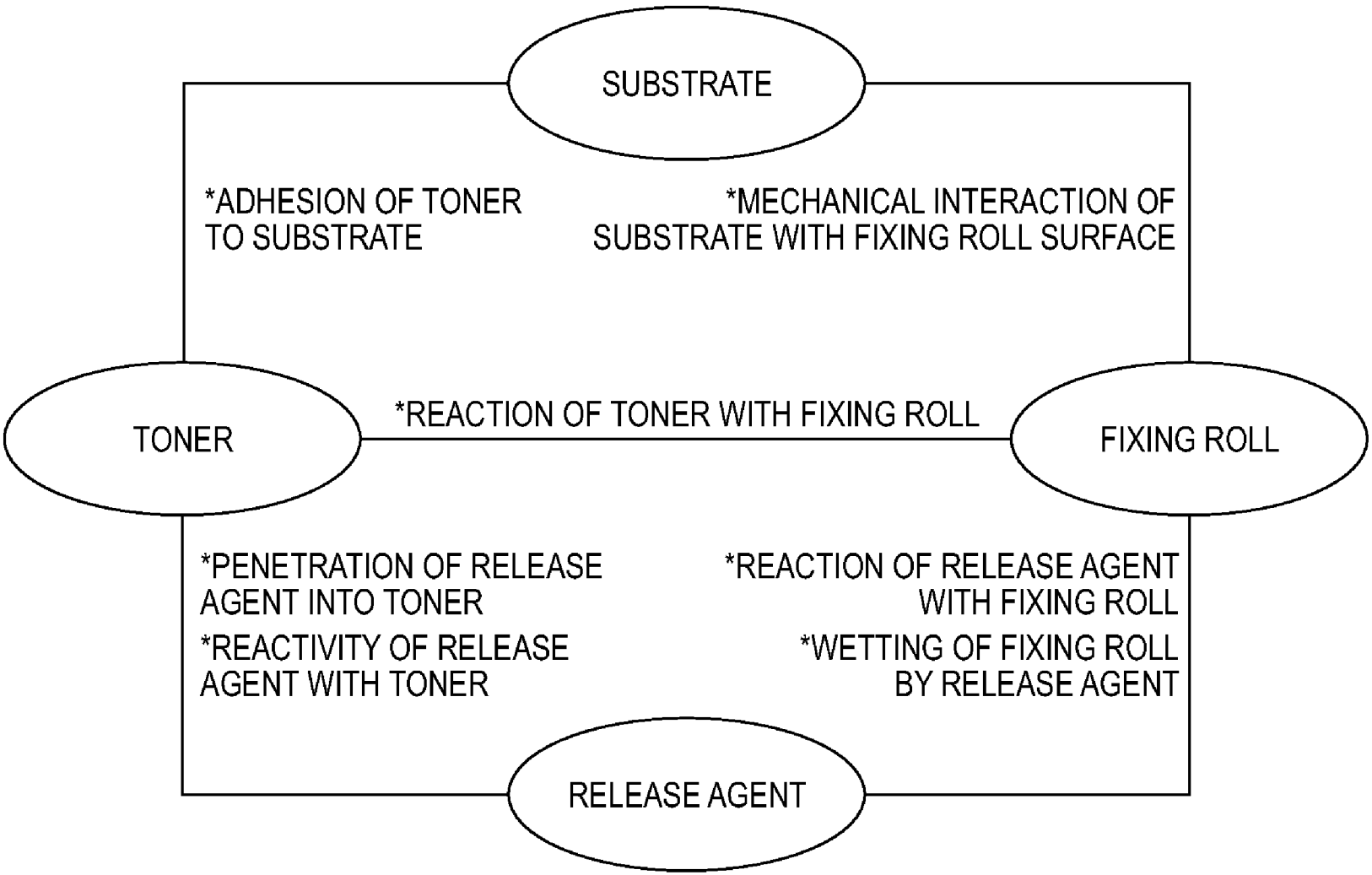
FIG. 1 illustrates mechanical and chemical interactions that may occur between components of a fixing device, toner and a release agent at a fixing nip.

The disclosed embodiments include multi-stage fixing systems for fixing toner to a substrate. An exemplary embodiment of the multi-stage fixing systems comprise a softening device for softening toner applied to a substrate by a marking device; and a fixing device for fixing the softened toner to the substrate. The fixing device comprises a first fixing member including a first surface; a first thermal energy source for actively heating the first surface; and a second fixing member including a second surface, the first surface and the second surface form a fixing nip at which the substrate with softened toner is received. The first fixing member and the second fixing member are operable to apply heat and pressure to the substrate and softened toner received at the fixing nip to fix the toner to the substrate.

Another exemplary embodiment of the multi-stage fixing systems comprises a softening device including a first thermal energy source for pre-heating toner applied to a substrate by a marking device to a first temperature of about 50° C. to about 110° C. to soften the toner; and a fixing device for fixing the softened toner to the substrate. The fixing device comprises a first fixing member including a first surface; a second thermal energy source for heating the first surface to a second temperature of about 50° C. to about 120° C.; and a second fixing member including a second surface, the first surface and the second surface form a fixing nip at which the substrate with softened toner is received. The first fixing member and the second fixing member are operable to apply heat and a pressure of about 300 psi to about 1500 psi to the substrate and softened toner at the fixing nip to fix the toner to the substrate.

The disclosed embodiments further include methods of fixing toner to a substrate in printing. An exemplary embodiment of the methods comprises applying toner to a substrate with a marking device; softening the toner applied to the substrate with a softening device of a multi-stage fixing system; feeding the substrate to a fixing nip of a fixing device of the multi-stage fixing system, the fixing device comprising a first fixing member including a first surface and a second fixing member including a second surface, the fixing nip being formed by the first surface and the second surface; heating the first surface of the first roll with a first thermal energy source; and applying heat and pressure to the substrate and softened toner at the fixing nip with the heated first fixing member and the second fixing member to fix the toner to the substrate.

Another exemplary embodiment of the methods of fixing toner to a substrate in printing comprises applying toner to a substrate with a marking device; pre-heating the toner applied to the substrate with a first thermal energy source of a softening device of a multi-stage fixing system, the toner being pre-heated to a first temperature of about 50° C. to about 110° C. to soften the toner; feeding the substrate to a fixing nip of a fixing device of the multi-stage fixing system, the fixing device comprising a first fixing member including a first surface and a second fixing member including a second surface, the fixing nip being formed by the first surface and the second surface; heating the first surface of the first fixing member roll to a second temperature of about 50° C. to about 120° C. with a second thermal energy source; and applying heat and a pressure of about 300 psi to about 1500 psi to the substrate and softened toner at the fixing nip with the heated first fixing member and the second fixing member to fix the toner to the substrate.

In some printing processes, images are formed on substrates using marking material comprising dry toner. These printing processes may utilize a contact fixing device having opposed fixing members that form a fixing nip. For example, one of the fixing members can include a fixing roll or a fixing belt and the other fixing member can include a pressure roll. In these fixing devices, a toner image formed on a substrate is fixed or fused by applying sufficient thermal energy and pressure to the substrate and toner image by contact with the fixing members at the fixing nip.

The fixing of toner onto a substrate can be achieved using high-temperature, low pressure conditions in contact fixing devices. These devices may utilize a roll or belt surface composed of elastomeric materials. In these devices, the elastomeric materials are typically subjected to high surface temperatures of 150° C. to 210° C. and relatively-low fixing nip pressures of 60 psi to 100 psi. At these high-temperature conditions, high-temperature-compatible elastomeric materials are required. These fixing devices are operated at high temperatures to fix the toner material onto the substrate at the fixing nip in milliseconds of dwell time.

FIG. 1 depicts complex mechanical and chemical interactions that may occur at a fixing nip between the substrate, toner, fixing roll and release agent in a contact fixing device during the fixing of toner onto a substrate. These interactions affect machine performance and service life. The use of high fixing temperatures and reactive chemicals creates a harsh mechanical and chemical operating environment for exposed elastomeric materials of the fixing members. Despite the use of high-temperature-compatible elastomeric materials in fixing devices, these harsh conditions present in contact fixing devices commonly lead to the premature failure of the fixing members.

Another approach to fixing toner onto a substrate in printing includes non-contact fusing processes that heat the toner material by use of a radiant energy source with no pressure, or low pressure. These fusing processes rely upon radiant energy absorption and viscoelastic flow by the toner material resulting from irradiating the toner with radiant energy. It has been determined that this approach may produce limited image quality, introduces higher material costs due to additional property requirements placed upon the toner material, and also results in limited substrate compatibility.

Another approach to toner fixing in printing includes contact fixing processes that use high pressure at ambient temperature to fix the toner to a substrate. Although this approach may avoid high-temperature conditions at the fixing nip, it places additional requirements on the toner material to enable adequate fixing of the toner onto substrates and typically produces images with limited image quality, particularly in color printing processes.

In view of the above observations regarding the mechanical and chemical interactions that may occur in a contact fixing device that utilizes high fixing temperatures, fixing systems, printing apparatuses and methods of fixing marking material comprising toner to a substrate in printing are provided. As used herein, the term "printing apparatus" can encompass various types of apparatuses that are used to form images on substrates with marking materials. These apparatuses can include printers, copy machines, facsimile machines, multifunction machines, and the like. The fixing systems, printing apparatuses and methods utilize a novel regime of applied pressures and temperatures for fixing toner to a substrate. Embodiments of the fixing systems, apparatuses and methods can produce a high image quality output while enabling use of robust, long-life subsystem components. The printing apparatuses and methods use a multi-stage fixing system for fixing toner. The multi-stage fixing system softens the toner material on a substrate, and then, at a fixing nip, subjects the softened toner to temperature and pressure conditions that are effective to flow the softened toner and provide adequate coalescence and adhesion of the toner to the substrate. The fixing systems, printing apparatuses and methods can use low temperatures and moderate pressures at the fixing nip to achieve fixing of the softened toner.

By performing the toner fixing process as a multi-stage process at relatively lower temperatures, lower demands are placed on components of the fixing device, enabling application of robust, long-life components. In addition, the use of relatively lower temperatures and moderate pressures can relax demands on the toner material composition and properties. Embodiments of the fixing system, printing apparatuses and methods can provide high image quality, a high level of printed image permanence, and reduced overall printing costs.

Figure 2:
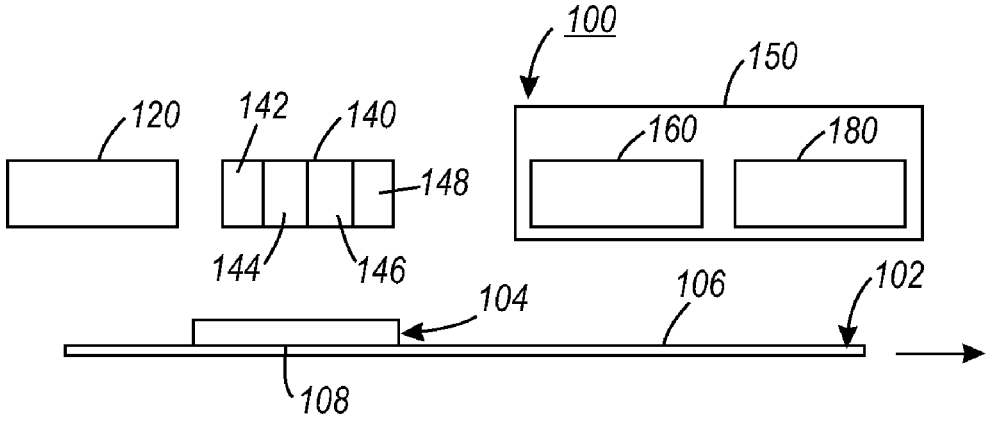
FIG. 2 depicts an exemplary embodiment of a printing apparatus.

FIG. 2 depicts an exemplary embodiment of a printing apparatus 100 for forming images on a substrate 102. The substrate 102 is a sheet. Continuous webs may also be used as the substrate in embodiments of the printing apparatus 100. The substrate 102 can comprise paper, which can be coated or uncoated. The substrate 102 may comprise packaging material. The printing apparatus 100 includes a substrate feeding device 120, a marking device 140 and a multi-stage fixing system 150 including a softening device 160 and a fixing device 180 downstream from the softening device 160. A substrate 102 is fed by the substrate feeding device 120 to the marking device 140 to apply marking material 104 to a front surface 106 of the substrate 102. The marking material 104 comprises toner. The substrate 102 is then fed to the multi-stage fixing system 150. The applied toner is softened by the softening device 160. Then, the substrate 102 is advanced to the fixing device 180 where sufficient heat and pressure are applied to adequately fix the softened toner to the front surface 106.

Embodiments of the marking device 140 can have any suitable configuration for applying marking material comprising toner to the substrate 102. In embodiments, the toner material comprises dry toner particles. The toner material may be a conventional toner or chemical toner. The toner may contain one or more additives. In the marking device 120, carrier particles may be used to assist in delivery of the toner material. The marking device 140 can be constructed to apply marking material directly to the substrate 102 to form toner images. In other embodiments, the marking device 140 can be constructed to apply marking material first to an intermediate member, such as a roll or belt, and then to transfer the marking material from the intermediate member to the substrate 102.

The illustrated embodiment of the marking device 140 includes four marking stations 142, 144, 146 and 148 arranged in series along the process direction of the printing apparatus 100. The marking stations 142, 144, 146 and 148 can each apply a marking material comprising a different color of toner material, such as black, cyan, magenta and yellow toner, respectively, to the front surface 106 of the substrate 102 to form a color image. The marking device 140 can also be used to produce monochromatic images. While the marking device 140 is shown as applying marking material 104 only to the front surface 106 of the substrate 102, other embodiments of the printing apparatus 100 can be configured to produce duplex prints.

In embodiments of the printing apparatus, the substrate 102 and marking material 104 may or may not be actively heated before the substrate 102 arrives at the softening device 160 of the multi-stage fixing system 150. When the substrate 102 and marking material 104 are not actively heated with a heating device to increase their temperature before the substrate 102 arrives at the softening device 160, the substrate 102 and marking material 104 are typically at about the ambient temperature of the cavity of the printing apparatus 100 when the substrate 102 arrives at the softening device 160.

The softening device 160 is provided in the multi-stage fixing system 150 to soften the toner on the substrate 102 before entering the fixing device 180. As used herein, the term "soften" means to reduce the elastic modulus of the toner. Some adhesion of the toner to the substrate and some coalescence of the toner particles may occur as a result of the softening with the softening device 160. The softened toner may be in a condition between being completely unfused and being completely fused (fully fused) to the substrate. The amount of fixing or fusing resulting from this first softening step is considered to be insufficient for the prints to be suitable for nominal applications of the prints. Additional fixing or fusing of the toner is achieved by the fixing device 180.

Embodiments of the softening device 160 can include at least one thermal energy source operable to pre-heat the substrate 102 and marking material 104 on the front surface 106 to achieve a sufficiently-high temperature at the interface 108 between the substrate 102 and marking material 104 to soften the toner. Embodiments of the softening device 160 can heat the substrate 102 and toner to achieve a temperature at the interface 108 of at least about 50° C., such as about 50° C. to about 110° C., about 50° C. to about 100° C., or about 60° C. to about 90° C. At the softening device 160, the toner may be subjected to a mechanical pressure of, e.g., about 300 psi to about 1000 psi to produce mechanical leveling or spreading of the toner on the substrate 102. In embodiments, the temperature at the interface 108 between the substrate 102 and marking material 104 can be raised to above the glass transition temperature and/or above the melting temperature of the overall toner to soften the toner material. For some formulations of the toner, at the interface 108, the toner may become a mixed phase resulting from plasticization of the toner. By pre-heating the substrate 102 and marking material 104 to temperatures of less than 100° C., for example, problems caused by the vaporization of water contained in print media, which include damage to the media (blistering) and/or damage to the images, can be avoided in the printing apparatus 100.

The softening device 160 can include any suitable thermal energy source that can pre-heat the substrate 102 and toner to the desired temperature to soften the toner. For example, the softening device 160 can include one or more non-contact heating devices, such as one or more radiant heating devices that emit radiant energy onto the substrate 102 and toner. The radiant heating devices can comprise flash lamps, or the like, which emit short-duration, high-intensity radiant energy; or lamps, light emitting diodes, or the like, which can emit radiant energy continuously; or convective heating devices, such as forced hot air or steam emitting devices, that apply a heated gas or vapor to the substrate 102 and marking material 104.

Pre-heating the substrate 102 and toner using the softening device 160 supplies energy to the substrate 102 and toner, which allows the fixing device 180 to be operated at lower fixing temperatures than fixing devices that do not utilize pre-heating and must heat toner from ambient temperature to the fixing temperature at the fixing nip within a short dwell time. In the printing apparatus 100, a lower fixing temperature can be used in the fixing device 180 for the same process speed, as compared to that which would have been applied in conventional fusing processes. This temperature of the fixing device 180 may be increased, as needed, to achieve toner fixing at higher process speeds.

In other embodiments, the softening device 160 can utilize chemical softening of the toner on the substrate 102, which comprises exposing the toner to a chemical effective to soften the toner. These softening techniques can be used alone, or in combination with heating of the toner.

The fixing device 180 is constructed to heat the softened toner to a sufficiently-high temperature with applied pressure to cause the softened toner to coalesce and provide adequate adhesion of the image to the substrate 102. When the softening device 160 pre-heats the toner, it is desirable to minimize the distance along the process direction between the outlet end of the softening device 160 and a fixing nip 186 of the fixing device 180 in order to minimize cooling of the pre-heated toner prior to reaching the fixing nip 186. For example, the pre-heated substrate 102 can typically be advanced from the outlet of the softening device 160 to the fixing nip 186 within about 50 ms to about 1000 ms.

Figure 3:
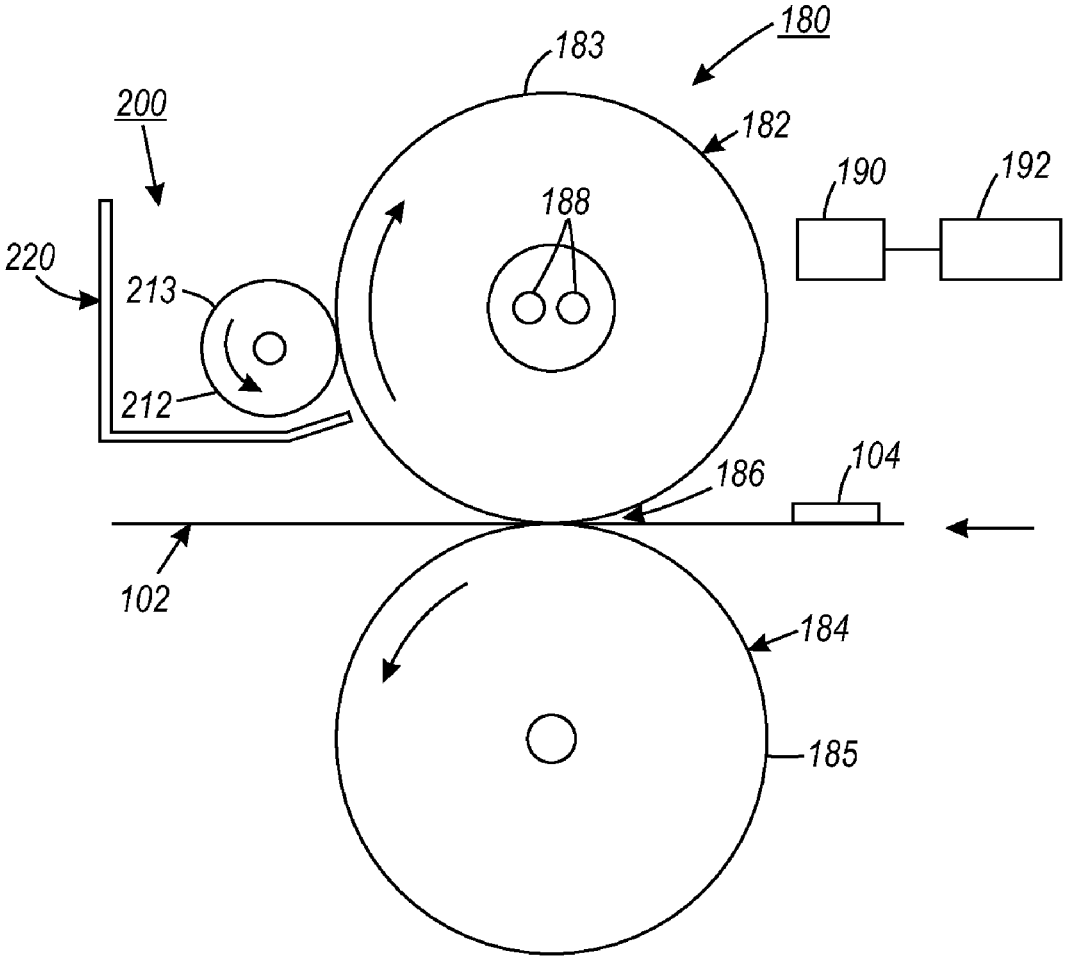
FIG. 3 depicts an exemplary embodiment of a fixing device of a fixing system.

An exemplary embodiment of the fixing device 180 is shown in FIG. 3. The illustrated fixing device 180 includes a fixing roll 182 and a pressure roll 184, which together form the fixing nip 186. The substrate 102 is fed to the fixing nip 186 at which the substrate 102 and marking material 104 are subjected to heating and applied pressure by the fixing roll 182 and pressure roll 184. In other embodiments, the fixing device may have a construction including a belt configuration for one or more of the fixing members, such as a fixing belt that is entrained on one or more rolls and arranged in combination with the pressure roll 184 to form a fixing nip at which thermal energy and pressure are applied to a substrate and toner.

The fixing roll 182 can be internally and/or externally heated by a thermal energy source to a desired temperature. As shown, the thermal energy source can comprise internal heating elements 188, such as axially-extending lamps, located inside of the fixing roll 182 and powered to heat the outer surface 183 to the fixing temperature. A power supply 190 is connected to the heating elements 188. The power supply 190 is connected to a controller 192 configured to control the supply of power to the heating elements 188. In other embodiments, the outer surface 183 can be externally heated by a thermal energy source by conduction, convection and/or radiation. For example, at least one external heating roll can be provided in contact with the outer surface 183.

In embodiments, the outer surface 183 of the fixing roll 182 can be comprised of a metallic material, a ceramic material, or a composite material. For example, the fixing roll 182 can comprise an aluminum substrate that has been subjected to an anodizing process to convert the surface region of the substrate, including the outer surface 183, to porous anodized aluminum (aluminum oxide, $Al_2O_3$). The open pores of the anodized surface region can be impregnated with a suitable material to seal the open pores. For example, the open pores can be impregnated with a substance having lubricating properties, such as polytetrafluoroethylene (Teflon®), or the like, to seal the pores. The resulting outer surface 183 provides a desirable hardness and release properties.

Following the sealing process, the outer surface 183 can be polished to a smooth finish. To achieve uniform pressures at the fixing nip 186 along the axial length of the fixing roll 182 over the entire applied pressure range, the fixing roll 182 or the pressure roll 184 can be crowned.

In other embodiments, the fixing roll 182 can include one or more outer layers, each comprised of a polymer or a polymer composite material. The outermost outer layer includes the outer surface 183. For example, the polymer can be polyurethane, nitrile butadiene rubber, or the like. Each outer layer can each have a thickness of, e.g., about 1 mm to about 15 mm. It is desirable to minimize the thickness of the outer layer(s) to improve thermal conductivity and allow desirable fixing performance in the temperature range of about 50° C. to about 120° C. The outer layer(s) can contain one or more filler materials to increase thermal conductivity, improve durability and/or improve static charge buildup. The outer layer(s) can provide improved spreading of toner during the fixing process, as well as improved release performance by the fixing roll 182.

In the low-temperature, moderate-pressure regime in which the fixing device 180 can be operated, embodiments of the fixing roll 182 that include an outer surface 183 comprised of anodized aluminum, and embodiments that include one or more polymeric outer layers, provide resistance to the complex mechanical and chemical interactions that occur at the fixing nip 186 during fixing of toner to substrates.

In embodiments, the pressure roll 184 can comprise a core and a polymeric material overlying the core and forming the outer surface 185. For example, the polymeric material can be polyurethane, nitrile butadiene rubber, or the like. The polymeric material can be applied as a single layer, or as two or more layers. Different layers of the multi-layer constructions can have a different composition and properties from each other, e.g., a different elastic modulus. The pressure roll 184 may be heated.

In the fixing device 180, the outer surface 183 of the fixing roll 182 is heated to a temperature that is suitable for fixing the toner formulation to the substrate 102. In embodiments, the temperature of the outer surface 183 (i.e., the fixing temperature) can be set to at least about 50° C., such as about 50° C. to about 120° C., about 70° C. to about 110° C., about 80° C. to about 110° C., or about 80° C. to about 100° C., for fixing the softened toner on the substrate 102. When the toner is softened by pre-heating, a relatively lower fixing temperature may be used in the fixing device 180 as compared to embodiments in which the toner is softened without pre-heating at the softening device 160. The outer surface 183 can be operated at a fixing temperature that is close to the pre-heated temperature of the toner, e.g., less than about 10° C. higher, or less than about 5° C. higher, than the pre-heated temperature.

During fixing, the toner image is highly viscous. Moderate pressure is applied at the fixing nip 186 to ensure adequate adhesion to the substrate and good coalescence for permanence and high image quality. In embodiments, the amount of pressure applied to the substrate 102 at the fixing nip 186 can range from about 300 psi to about 3000 psi, such as about 300 psi to about 1500 psi, or about 400 psi to about 1000 psi. Increasing the fixing pressure at the fixing device 180 can allow a lower fixing temperature to be used.

In the printing apparatus 100, the pre-heating temperature achieved by the softening device 160 and the fixing temperature achieved by the fixing device 180 can be adjusted for different substrate materials and types. For a heavy-weight paper substrate 102 (coated or uncoated), the pre-heating temperature and/or the fixing temperature can be increased at a given dwell time, as compared to the pre-heating and fixing temperatures used for a light-weight paper substrate 102.

The temperature and pressure conditions used at the softening device 160 and the fixing device 180 can be selected based on the melting temperature of the toner material used to form prints. For example, in an embodiment, the softening device 160 can be operated at a pre-heating temperature of about 80° C. to about 90° C., and the fixing device 180 can be operated at a fixing temperature of about 80° C. to about 100° C. and a nip pressure of about 400 psi to about 700 psi to fix a first toner material to substrates. For a second toner material having a higher melting temperature than the first toner material, the softening device 160 can be operated at a pre-heating temperature of about 90° C. to about 110° C., and the fixing device 180 can be operated at a fixing temperature of about 100° C. to about 110° C. and a nip pressure of about 400 psi to about 700 psi to fix the second toner material to substrates. In embodiments, the pre-heating temperature and the fixing temperature can be tuned to melt the toner material at the fixing nip.

As shown in FIG. 3, the fixing device 180 can include a release agent applicator system 200 for applying a release agent to the outer surface 183 of the fixing roll 182. The release agent is formulated to prevent adherence of toner to the fixing roll and to assist in stripping of the substrate from the fixing roll following fixing. The illustrated release agent applicator system 200 includes a release agent applicator roll 212 having an outer surface 213. The applicator roll 212 is rotatable to apply release agent to the outer surface 183. A tray 220 is positioned to collect residual release agent.

In embodiments of the fixing device 180, softening of toner combined with use of a relatively lower temperature at the fixing nip 186 can be further enabled through the use of low-melting and ultra-low-melting toner materials characterized as having a melting temperature that is altered (lowered) by heating the toner to a temperature above a threshold temperature and then re-heating the toner having the lowered melting temperature. Exemplary ultra-low-melting toners having these characteristics comprise a crystalline polymer material, such as crystalline polyester material, and an amorphous polymer material, such as amorphous polyester material, with the amorphous material having a glass transition temperature ($T_g$) separate from the melting temperature ($T_m$) of the crystalline material. In these toners, the crystalline polymer material imparts a low melting temperature to the toner. Exemplary toners having alterable melting temperature characteristics that may be used in the fixing device are disclosed in U.S. Pat. Nos. 7,402,371; 7,494,757 and 7,547,499, each of which is incorporated herein by reference in its entirety.

Toners having such temperature-alterable melting characteristics can be used in the fixing device 180 to further enhance the effectiveness of the pre-heating of the substrate 102 and toner in the fixing process. These toners can undergo a reduction in their melting temperature prior being fixed to the substrate 102 at the fixing nip 186 by being pre-heated using the softening device 160. As the substrate 102 is advanced to the fixing nip 186, additional thermal energy is applied to the substrate 102 and toner with the heated fixing roll 182.

Using a toner material having a low melting temperature, allows the process conditions of temperature (thermal energy input), pressure and/or dwell (print speed) to be lowered in the fixing nip 186 of the fixing device 182. Suitable toner materials may be expanded over other fusing approaches to provide optimal image quality, and low materials cost is enabled.

By operating at reduced toner temperatures in embodiments of the fixing systems, printing apparatuses, improved system/substrate path robustness without toner blocking problems in output stacks can be achieved.

As the operating set-points used in embodiments of the fixing systems and printing apparatuses accommodate low substrate temperatures, substrate distortion issues that can occur at elevated process temperatures can be avoided. This feature can extend the substrate application space achieved with xerographic printing systems. For example, polymeric film materials used in packaging may be used as the substrate in the fixing systems and printing apparatuses. The use of low operating temperatures also reduces or avoids water evaporation and reabsorption by paper and, consequently, can minimize or eliminate this potential source for paper distortion.

EXAMPLES

Figure 4:
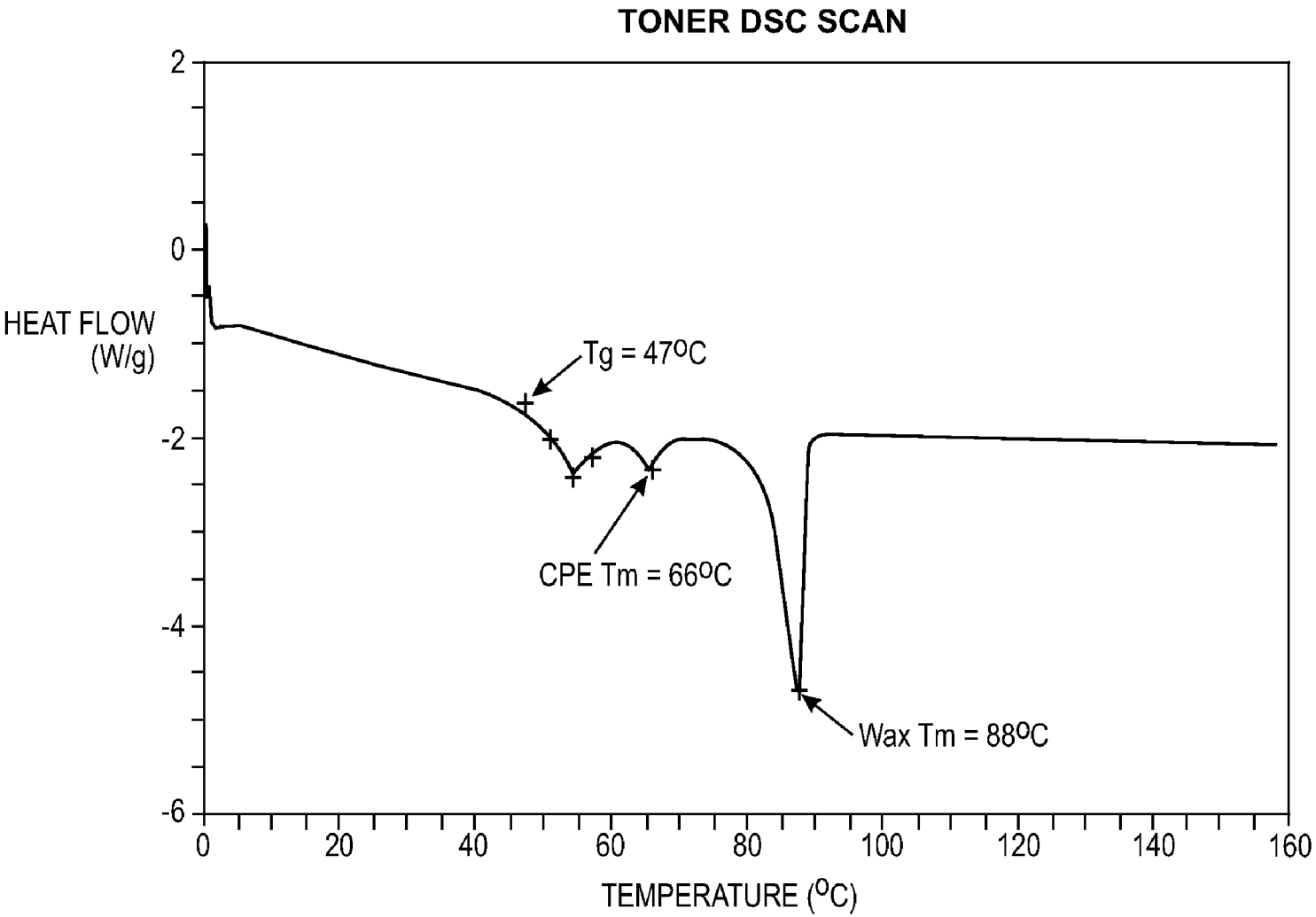
FIG. 4 shows a differential scanning calorimetry scan of heat flow versus temperature for a toner material.

A fixing system including a softening device including a radiant heater for pre-heating, and a fixing device including a fixing roll and pressure roll are used. The fixing roll is an aluminum roll with a polished, anodized aluminum surface. A light coating (~1 mg/sheet) of release agent (Copy Aid 270 silicone fluid manufactured by Wacker Chemical Corporation of Adrian Mich.) is applied to the anodized aluminum surface. Uncoated and coated paper substrates are used. The toner applied to the substrate has a low melting point. FIG. 4 shows a differential scanning calorimetry scan of heat flow versus temperature for the toner material. The toner contains a crystalline polyester resin, an amorphous polyester resin and a wax, and is cyan colored. As shown, the amorphous base resin has a glass transition onset temperature, $T_g$, of 47° C., the crystalline polyester resin has a melting temperature, CPE $T_m$, of 66° C., and the wax has a melting temperature, Wax $T_m$, of 88° C. The substrate with applied toner is passed beneath the radiant heater element to elevate the temperature of the toner/substrate interface to just above its melting point. The radiant heater includes a black body radiating element to minimize color dependency of the energy absorption by the toner. The radiant heater has an extended zone to allow toner temperature levels to be achieved without excessive heating of the substrate. In the radiant heating zone, the time duration of the radiating of the toner (~0.5 seconds) and the toner/substrate interface temperature (~90° C.) are sufficient to promote viscoelastic softening of the overall toner composition.

The pre-heated substrate with toner is fed to the fixing nip of the fixing device. The temperature of the outer surface of the fixing roll is at or near the melt temperature, Wax $T_m$, of the wax component in the toner, i.e., about 90° C. A nip pressure of about 1000 psi is applied at the fixing nip to enable adequate flow of the toner material to the substrate to attain good adhesion and blending of multi-layered color toners. These results are demonstrated with both a crease metric, which evaluates adhesive fix to the substrate, and an abrasive rub metric, which assesses coalescence of the toner layer. With the toner material contacting the anodized aluminum surface using a relatively short dwell nip, and a light coating of release agent, an appropriate level of gloss is achieved on the coated and uncoated papers.

Figure 5:
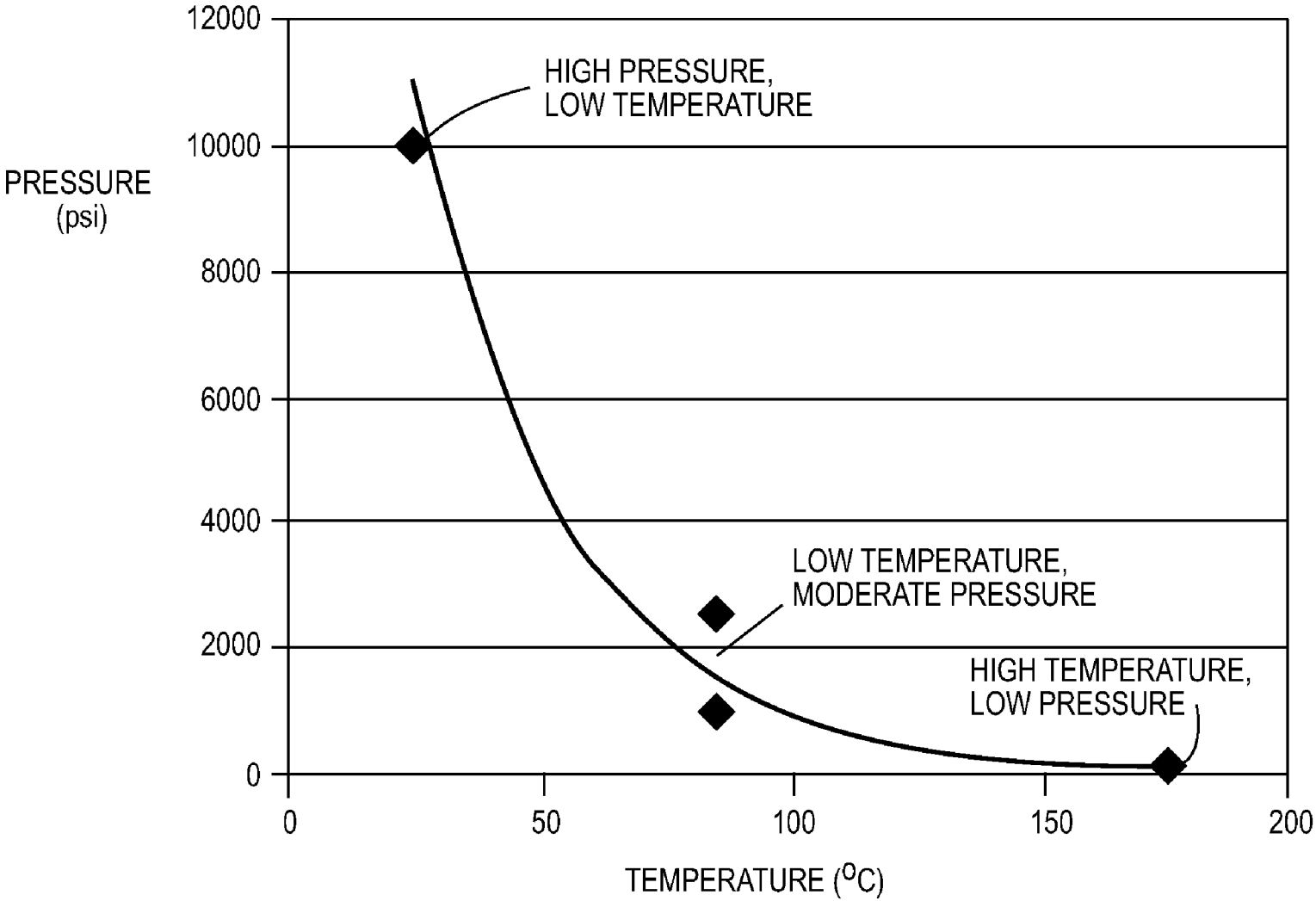
FIG. 5 shows a plot of fixing pressure versus fixing temperature to achieve a selected image fix level of a toner to uncoated paper with fixing devices that utilize high pressure and low temperature, low temperature and moderate pressure, and high temperature and low pressure.

FIG. 5 shows a fixing nip pressure versus fixing temperature profile using the toner having a differential scanning calorimetry scan of heat flow versus temperature as shown in FIG. 4, used to achieve a particular image fix level as measured by the crease test. The data points in FIG. 5 represent a toner fixing process that uses low temperature and moderate pressure conditions at the fixing nip and, for comparison, a fixing process that uses low temperature (ambient temperature) and high pressure conditions, and a fixing process that uses high temperature and low pressure conditions.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A multi-stage fixing system for fixing toner to a substrate, comprising:

a softening device for softening toner applied to a substrate by a marking device; and a fixing device for fixing the softened toner to the substrate, the fixing device comprising:

a first fixing member including a first surface;

a first thermal energy source for actively heating the first surface to a temperature of about 50° C. to a value less than 110° C.; and a second fixing member including a second surface, the first surface and the second surface form a fixing nip at which the substrate with softened toner is received, wherein the first fixing member and the second fixing member are operable to apply heat and pressure to the substrate and softened toner received at the fixing nip to fix the toner to the substrate the softening device exposes the toner on the substrate to a chemical effective to soften the toner, and the softening device comprises a second thermal energy source for heating the toner on the substrate to a temperature effective to soften the toner.

2. The multi-stage fixing system of claim 1, wherein the second thermal energy source comprises at least one radiant energy source operable to emit radiant energy onto the toner disposed on the substrate to heat the toner to the temperature effective to soften the toner.

3. The multi-stage fixing system of claim 1, wherein: the first fixing member comprises a first roll including the first surface; and the second fixing member comprises a second roll including the second surface; surface, wherein the first roll and the second roll are operable to apply sufficient heat and pressure to the substrate and pre-heated toner received at the fixing nip to fix the toner to the substrate.

4. The multi-stage fixing system of claim 1, wherein the softening device applies mechanical pressure to the toner on the substrate.

5. The multi-stage fixing system of claim 1, wherein the toner comprises a crystalline polymer material and an amorphous polymer material, and the toner has a melting temperature which is lowered by heating the toner to a temperature above a threshold temperature.

6. The multi-stage fixing system of claim 1, further comprising a release agent applicator system for applying a release agent to the first surface of the first fixing member.

7. A printing apparatus, comprising:

a marking device comprising at least one marking station, each marking station contains a supply of toner for applying to a substrate; and the multi-stage fixing system of claim 1 disposed downstream from the marking device.

8. A multi-stage fixing system for fixing toner to a substrate, comprising:

a softening device including a first thermal energy source for pre-heating toner applied to a substrate by a marking device to a first temperature of about 50° C. to about 110° C. to soften the toner; and a fixing device for fixing the softened toner to the substrate, the fixing device comprising:

a first fixing member including a first surface;

a second thermal energy source for heating the first surface to a second temperature of about 50° C. to a value less than 110° C.; and a second fixing member including a second surface, the first surface and the second surface form a fixing nip at which the substrate with softened toner received wherein the first fixing member and the second fixing member are operable to apply heat and a pressure of about 300 psi to about 1500 psi to the substrate and softened toner at the fixing nip to fix the toner to the substrate, and the softening device also exposes the toner on the substrate to a chemical effective to soften the toner.

9. The multi-stage fixing system of claim 8, wherein the first temperature is about 80° C. to about 90° C.;

the second temperature is about 80° C. to about 100° C.;

the pressure is about 400 psi to about 700 psi; and the toner is melted at the fixing nip.

10. The multi-stage fixing system of claim 8, wherein the first temperature is about 90° C. to about 110° C.;

the second temperature is about 100° C. to a value less than 110° C.;

the pressure is about 400 psi to about 700 psi; and the toner is melted at the fixing nip.

11. The multi-stage fixing system of claim 8, wherein the first thermal energy source comprises at least one radiant energy source operable to emit radiant energy onto the toner disposed on the substrate to heat the toner to the first temperature.

12. The multi-stage fixing system of claim 8, wherein the softening device applies mechanical pressure to the toner on the substrate.

13. The multi-stage fixing system of claim 8, wherein:

the first fixing member comprises a first roll including the first surface; and the second fixing member comprises a second roll including the second surface.

14. The multi-stage fixing system of claim 13, wherein the second thermal energy source comprises at least one heating element inside of the first roll for heating the first surface.

15. The multi-stage fixing system of claim 13, wherein:

the first surface of the first roll comprises a metallic, ceramic or composite material; and the second surface of the second roll comprises a polymer or a polymer composite material.

16. The multi-stage fixing system of claim 15, wherein:

the first surface of the first roll comprises anodized aluminum; and the second surface of the second roll comprises polyurethane.

17. The multi-stage fixing system of claim 13, wherein:

the first roll comprises at least one outer layer comprising polyurethane; and the second surface of the second roll comprises polyurethane.

18. The multi-stage fixing system of claim 8, wherein the toner comprises a crystalline polymer material and an amorphous polymer material, and the toner has a melting temperature which is lowered by heating the toner to a temperature above a threshold temperature.

19. The multi-stage fixing system of claim 8, further comprising a release agent applicator system for applying a release agent to the first surface of the first fixing member.

20. A printing apparatus, comprising:

a marking device comprising at least one marking station, each marking station contains a supply of toner for applying to a substrate; and the multi-stage fixing system of claim 10 disposed downstream from the marking device.

21. The printing apparatus of claim 20, wherein the substrate and toner are at a temperature of about an ambient temperature of a cavity of the printing apparatus when the substrate is subjected to softening at the softening device.

22. A method of fixing toner to a substrate in printing, comprising:

applying toner to a substrate with a marking device;

softening the toner applied to the substrate with a softening device of a multi-stage fixing system;

feeding the substrate to a fixing nip of a fixing device of the multi-stage fixing system, the fixing device comprising a first fixing member including a first surface and a second fixing member including a second surface, the fixing nip being formed by the first surface and the second surface;

heating the first surface of the first roll with a first thermal energy source to a temperature of about 50° C. to a value less than 110° C.; and applying heat and pressure to the substrate and softened toner at the fixing nip with the heated first fixing member and the second fixing member to fix the toner to the substrate, wherein the softening device exposes the toner on the substrate to a chemical effective to soften the toner, and the softening device comprises a second thermal energy source for heating the toner on the substrate to a temperature effective to soften the toner.

23. The method of claim 22, wherein the substrate and toner are at a temperature of about an ambient temperature of a cavity of a printing apparatus comprising the multi-stage fixing system when the substrate is softened at the softening device.

24. The method of claim 22, wherein the softening device applies mechanical pressure to the toner on the substrate.

25. The method of claim 22, wherein:

the toner comprises a crystalline polymer material and an amorphous polymer material, and the toner has a melting temperature which is lowered by heating the toner to a temperature above a threshold temperature; and the toner is heated to a temperature above the melting temperature at the fixing nip.

26. A method of fixing toner to a substrate in printing, comprising:

applying toner to a substrate with a marking device;

pre-heating the toner applied to the substrate with a first thermal energy source of a softening device of a multi-stage fixing system, the toner being pre-heated to a first temperature of about 50° C. to about 110° C. to soften the toner;

feeding the substrate to a fixing nip of a fixing device of the multi-stage fixing system, the fixing device comprising a first fixing member including a first surface and a second fixing member including a second surface, the fixing nip being formed by the first surface and the second surface;

heating the first surface of the first fixing member roll to a second temperature of about 50° C. to a value less than 110° C. with a second thermal energy source; and applying heat and a pressure of about 300 psi to about 1500 psi to the substrate and softened toner at the fixing nip with the heated first fixing member and the second fixing member to fix the toner to the substrate, wherein the softening device also exposes the toner on the substrate to a chemical effective to soften the toner.

27. The method of claim 26, wherein the first temperature is about 80° C. to about 90° C.;

the second temperature is about 80° C. to about 100° C.;

the pressure is about 400 psi to about 700 psi; and the toner is melted at the fixing nip.

28. The method of claim 26, wherein the first temperature is about 90° C. to about 110° C.;

the second temperature is about 100° C. to a value less than 110° C.;

the pressure is about 400 psi to about 700 psi; and the toner is melted at the fixing nip.

29. The method of claim 26, wherein the first thermal energy source comprises at least one radiant energy source which emits radiant energy onto the toner disposed on the substrate to heat the toner to the first temperature.

30. The method of claim 26, wherein the softening device applies mechanical pressure to the toner on the substrate.

31. The method of claim 26, wherein:

the first fixing member comprises a first roll including the first surface;

the second fixing member comprises a second roll including the second surface; and the second thermal energy source comprises at least one heating element inside of the first roll for heating the first surface.

32. The method of claim 31, wherein:

the first surface of the first roll comprises a metallic, ceramic or composite material; and the second surface of the second roll comprises a polymer or a polymer composite material.

33. The method of claim 32, wherein:

the first surface of the first roll comprises anodized aluminum; and the second surface of the second roll comprises polyurethane.

34. The method of claim 31, wherein:

the first roll comprises at least one outer layer comprising polyurethane; and the second surface of the second roll comprises polyurethane.

35. The method of claim 26, wherein the toner comprises a crystalline polymer material and an amorphous polymer material, and the toner has a melting temperature which is lowered by heating the toner to a temperature above a threshold temperature.

36. The method of claim 26, further comprising applying a release agent to the first surface of the first fixing member.

37. The method of claim 26, wherein the substrate comprises paper.

38. The method of claim 26, wherein the substrate comprises a polymeric film.

39. The method of claim 26, wherein the substrate with the softened toner is advanced from the softening device to the fixing nip within a period of about 50 ms to about 1000 ms.

* * * * *